US010446080B2

(12) United States Patent
Chen et al.

(10) Patent No.: US 10,446,080 B2
(45) Date of Patent: Oct. 15, 2019

(54) DISPLAY PANEL, PIXEL DRIVING CIRCUIT, AND DRVING METHOD THEREOF

(71) Applicant: Shenzhen China Star Optoelectronics Semiconductor Display Technology Co., Ltd., Shenzhen, Guangdong (CN)

(72) Inventors: Xiaolong Chen, Guangdong (CN); Yi-Chien Wen, Guangdong (CN); Ming-Jong Jou, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 133 days.

(21) Appl. No.: 15/744,081

(22) PCT Filed: Nov. 30, 2017

(86) PCT No.: PCT/CN2017/113927

§ 371 (c)(1),
(2) Date: Jan. 12, 2018

(87) PCT Pub. No.: WO2018/196379

PCT Pub. Date: Nov. 1, 2018

(65) Prior Publication Data

US 2018/0374420 A1 Dec. 27, 2018

(30) Foreign Application Priority Data

Apr. 28, 2017 (CN) ..... 2017 1 0297654

(51) Int. Cl.
*G09G 3/3233* (2016.01)

(52) U.S. Cl.
CPC ..... *G09G 3/3233* (2013.01); *G09G 2230/00* (2013.01); *G09G 2300/0819* (2013.01);
(Continued)

(58) Field of Classification Search
CPC ..... G09G 3/3233; G09G 2230/00; G09G 2320/045; G09G 2320/0233;
(Continued)

(56) References Cited

U.S. PATENT DOCUMENTS

2005/0179625 A1 8/2005 Choi
2006/0022605 A1 2/2006 Ha et al.
(Continued)

FOREIGN PATENT DOCUMENTS

CN 101305409 A 11/2008
CN 102654974 A 9/2012
(Continued)

*Primary Examiner* — Alexander Eisen
*Assistant Examiner* — Kebede T Teshome
(74) *Attorney, Agent, or Firm* — Andrew C. Cheng

(57) ABSTRACT

The present application provides a pixel driving circuit, which comprises a driving transistor, which comprises a gate terminal, a source terminal, and a drain terminal. The source terminal is respectively connected with a driving-voltage-signal terminal and a charge-voltage terminal via a first switch and a second switch. The charge-voltage terminal is connected with a data-voltage-signal terminal via a third switch. The gate terminal is connected with an initial-voltage-signal terminal via a fourth switch, and the gate terminal is connected with the drain terminal via a fifth switch. A first capacitor is connected with the gate terminal and the charge-voltage terminal, a second capacitor is connected with the gate terminal and a ground terminal. The present application further provides a pixel driving method and a display panel.

14 Claims, 8 Drawing Sheets

(52) U.S. Cl.
CPC ..... *G09G 2310/021* (2013.01); *G09G 2310/0216* (2013.01); *G09G 2320/0233* (2013.01); *G09G 2320/043* (2013.01); *G09G 2320/045* (2013.01)

(58) Field of Classification Search
CPC ..... G09G 2320/043; G09G 2310/0216; G09G 2310/021
See application file for complete search history.

(56) References Cited

U.S. PATENT DOCUMENTS

| | | | |
|---|---|---|---|
| 2006/0066532 | A1 | 3/2006 | Jeong |
| 2008/0211746 | A1 | 9/2008 | Caligiore et al. |

FOREIGN PATENT DOCUMENTS

| | | | |
|---|---|---|---|
| CN | 102831859 | A | 12/2012 |
| CN | 104217679 | A | 12/2012 |
| CN | 103035201 | A | 4/2013 |
| CN | 103050080 | A | 4/2013 |
| CN | 103117041 | A | 5/2013 |
| CN | 103150991 | A | 6/2013 |
| CN | 103198793 | A | 7/2013 |
| CN | 103839520 | A | 6/2014 |
| CN | 104332136 | A | 2/2015 |
| CN | 104464607 | A | 3/2015 |
| CN | 104575378 | A | 4/2015 |
| CN | 106297662 | A | 1/2017 |
| CN | 106409227 | A | 2/2017 |
| CN | 106887210 | A | 6/2017 |
| KR | 20060024869 | A | 3/2006 |
| KR | 20120043301 | A | 5/2012 |

DISPLAY PANEL, PIXEL DRIVING CIRCUIT, AND DRVING METHOD THEREOF

BACKGROUND OF THE APPLICATION

This application claims the priority of an application No. 201710297654.9 filed on Apr. 28, 2017, entitled "DISPLAY PANEL, PIXEL DRIVING CIRCUIT, AND DRIVING METHOD THEREOF", the contents of which are hereby incorporated by reference.

FIELD OF APPLICATION

The present application relates to a field of display technology, and more particularly to a pixel driving circuit, a driving method thereof, and a display panel comprises the pixel driving circuit.

DESCRIPTION OF PRIOR ART

Due to the instability and technical limitations of the organic light-emitting diode (OLED) display panel manufacturing process, the threshold voltage of the driving transistor of each pixel unit in the OLED display panel may be different, which may result in inconsistence in the current in the LED of each pixel unit, thereby causing the uneven brightness of the OLED display panel.

In addition, as the driving time of the driving transistor goes by, the material of the driving transistor will be aged or mutated, causing the threshold voltage of the driving transistor to drift. Moreover, the degrees of aging of the material of the driving transistors are different, resulting in different threshold voltage drifts of the driving transistors in the OLED display panel, which may also cause the display unevenness of the OLED display panel, and the display unevenness may become more serious with the driving time and the aging of the drive transistor material.

SUMMARY OF THE APPLICATION

In view of the above problems, an object of the present application is to provide a pixel driving circuit, a driving method thereof and a display panel comprising the pixel driving circuit so as to improve brightness uniformity of the display panel.

In order to solve the problems in the prior art, the present application provides a pixel driving circuit, which comprises a driving transistor, a first switch, a second switch, a third switch, a fourth switch, a fifth switch, a first capacitor, a second capacitor, a charge-voltage terminal, an initial-voltage-signal terminal, a data-voltage-signal terminal, and a driving-voltage-signal terminal. The driving transistor comprises a gate terminal, a source terminal, and a drain terminal.

The source terminal is respectively connected with the driving-voltage-signal terminal and the charge-voltage terminal via the first switch and the second switch. The charge-voltage terminal is connected with the data-voltage-signal terminal via the third switch. The gate terminal is connected with the initial-voltage-signal terminal via the fourth switch, and the gate terminal is connected with the drain terminal via the fifth switch.

The first capacitor is connected with the gate terminal and the charge-voltage terminal, the second capacitor is connected with the gate terminal and a ground terminal.

Wherein the pixel driving circuit further comprises a first control-signal terminal and a second control-signal terminal.

The first control-signal terminal and second control-signal terminal are respectively connected with a control terminal of the first switch and a control terminal of the second switch, so as to control on/off of the first switch and the second switch.

Wherein the pixel driving circuit further comprises a third control-signal terminal and a fourth control-signal terminal. The third control-signal terminal and the fourth control-signal terminal are respectively connected with a control terminal of the third switch and a control terminal of the fourth switch, so as to control on/off of the third switch and the fourth switch.

Wherein the pixel driving circuit further comprises a fifth control-signal terminal. The fifth control-signal terminal is connected with a control terminal of the fifth switch, so as to control on/off of the fifth switch.

Wherein the pixel driving circuit further comprises a sixth switch, a light-emitting diode and a negative voltage-signal terminal. The first control-signal terminal is connected with a control terminal of the sixth switch to control on/off of the sixth switch. The light-emitting diode comprises a positive terminal and a negative terminal. The sixth switch is connected between the drain terminal and the positive terminal to control on/off of the driving transistor and the light-emitting diode. The negative terminal is connected with the negative voltage-signal terminal.

The embodiment of the present application provides a display panel, which comprises the pixel driving circuit in any of the above embodiments.

The embodiment of the present application provides a pixel driving method, which comprises:

A pixel driving circuit is provided. The pixel driving circuit comprises a driving transistor, a first capacitor, a second capacitor, and a charge-voltage terminal; the driving transistor comprises a gate terminal, a source terminal and a drain terminal. The first capacitor is connected with the gate terminal and the charging voltage terminal. The second capacitor is connected with the gate terminal and the ground terminal.

A reset phase, an initial voltage is loaded at the gate terminal and a data voltage is loaded at the charge-voltage terminal, so as to reset a potential of the charge-voltage terminal and a potential of the gate terminal.

A storage phase, the data voltage is loaded at the charge-voltage terminal, the charge-voltage terminal and the source terminal are turned on, and the gate terminal and the drain terminal are turned on, so that the gate terminal is charged by the data voltage until a potential difference between the source terminal and the gate terminal is Vth, the Vth is the threshold voltage of the driving transistor. The Vth is stored in the first capacitor. A potential of the gate terminal is stored in the second capacitor.

A lighting phase, a driving voltage is loaded at the source terminal and the charge-voltage terminal, so as to change the potential of the gate terminal to stabilize the driving current of the driving transistor.

Wherein the pixel driving circuit further comprises a first switch, a second switch, a third switch, a fourth switch, a fifth switch, a sixth switch, a light-emitting diode, a first control-signal terminal, a second control-signal terminal, a third control-signal terminal, a fourth control-signal terminal, a fifth control-signal terminal, an initial-voltage-signal terminal, a data-voltage-signal terminal, and a driving-voltage-signal terminal. The source terminal is respectively connected with the driving-voltage-signal terminal and the charge-voltage terminal via the first switch and the second switch. The charge-voltage terminal is connected with the data-voltage-signal terminal via the third switch; the gate terminal is connected with the initial-voltage-signal terminal via the fourth switch. The gate terminal is connected with the drain terminal via the fifth switch. The sixth switch is connected between the drain terminal and the light-emitting diode. The first control-signal terminal is connected with a control terminal of the first switch and a control terminal of the sixth switch. The second control-signal terminal is connected with a control terminal of the second switch. The third control-signal terminal and the fourth control-signal terminal are respectively connected with a control terminal of the third switch and a control terminal of the fourth switch. The fifth control-signal terminal is connected with a control terminal of the fifth switch.

In the reset phase, the third control-signal terminal and the fourth control-signal terminal are loaded with a low-level signal, the first control-signal terminal, the second control-signal terminal, and the fifth control-signal terminal are loaded with a high-level signal, to turn on the third switch and the fourth switch, and turn off the first switch, the second switch, the fifth switch, and the sixth switch, the charge-voltage terminal is loaded with the data voltage via the third switch, the data voltage is Vdata, the gate terminal is loaded with the initial voltage via the fourth switch.

Wherein in the storage phase, the second control-signal terminal, the third control-signal terminal and the fifth control-signal terminal are loaded with a low-level signal, the fourth control-signal terminal and the first control-signal terminal are loaded with a high-level signal, to turn on the second switch, the third switch, and the fifth switch, and turn off the first switch, the fourth switch, and the sixth switch turn off, the source terminal is loaded with the data voltage via the second switch and the third switch, and the gate terminal is charged with the data voltage via data voltage the third switch, the second switch, the driving transistor, and the fifth switch, until a potential of the gate terminal is Vdata−Vth.

Wherein the pixel driving circuit further comprises a negative voltage-signal terminal. The light-emitting diode comprises a positive terminal and a negative terminal. The sixth switch is connected between the drain terminal and the positive terminal. The negative terminal is connected with the negative voltage-signal terminal.

In the lighting phase, the third control-signal terminal, the fifth control-signal terminal and the fourth control-signal terminal are loaded with a high-level signal, the first control-signal terminal and the second control-signal terminal are loaded with a low-level signal, so as to turn on the third switch, the first switch, and the sixth switch, and turn off the second switch, the fifth switch, and the fourth switch are turned off. The source terminal is loaded with the driving voltage via the first switch. The driving voltage is Vdd. The charge-voltage terminal is charged with the driving voltage charges via the first switch and the third switch. The potential of the gate terminal is Vdata−Vth+δV, and the potential difference between the source terminal and the gate terminal is Vdd−Vdata+Vth−δV, and δV=Vdd−Vdata*C1/C1+C2), C1 is a capacitance value of the first capacitor; C2 is a capacitance value of the second capacitor, so that the driving current is independent of the threshold voltage. The first switch, the driving transistor and the sixth switch are turned on, so that the driving-voltage-signal terminal and the negative voltage-signal terminal are turned on, for driving the light-emitting diode light by the driving current.

The gate terminal is charged by the data-voltage-signal terminal until the potential difference between the source terminal and the gate terminal is the threshold voltage Vth of the driving transistor, and the charge-voltage terminal is charged by the driving-voltage-signal terminal until the potential difference between the source terminal and the gate terminal is Vdd−Vdata+Vth−δV, such that the driving current $I=k(Vref-Vdata-\delta V)^2$, so that the driving current is independent of the threshold voltage Vth, so that the current of the light-emitting diode is stable to ensure that the evenly lighting brightness of the light-emitting diode.

The pixel driving method provided by the present application, during the reset phase, the charge-voltage terminal and the gate terminal are reset; during the storage phase, the gate terminal is charged by the data-voltage-signal terminal until the potential difference between the source terminal and the gate terminal is the threshold voltage Vth of the driving transistor, and the charge-voltage terminal is charged by the driving-voltage-signal terminal until the potential difference between the source terminal and the gate terminal is Vdd−Vdata+Vth−δV, such that the driving current $I=k(Vref-Vdata-\delta V)^2$, so that the driving current is independent of the threshold voltage Vth, so that the current of the light-emitting diode is stable to ensure that the evenly lighting brightness of the light-emitting diode.

The display panel provided by the present application comprises the pixel driving circuit described above, so that the driving current generated by the driving transistor is independent of the threshold voltage of the driving transistor, so as to stabilize the driving current generated by the driving transistor and eliminate the driving current issues caused by the aging of the driving transistor or the limitation of the manufacturing process, the problem of threshold voltage drift is solved, so that the current flowing through the light-emitting diode is stabilized, the light emitting brightness of the light-emitting diode is uniform, and the display effect of the screen is improved.

BRIEF DESCRIPTION OF THE DRAWINGS

In order to describe the technical solutions in the embodiments of the present application or in the conventional art more clearly, the accompanying drawings required for describing the embodiments or the conventional art are briefly introduced. Apparently, the accompanying drawings in the following description only show some embodiments of the present application. For those skilled in the art, other drawings may be obtained based on these drawings without any creative work.

DETAILED DESCRIPTION OF THE PREFERRED EMBODIMENTS

The technical solutions in the embodiments of the present application are clearly and completely described below with reference to the accompanying drawings in the embodiments of the present application.

Figure 1:
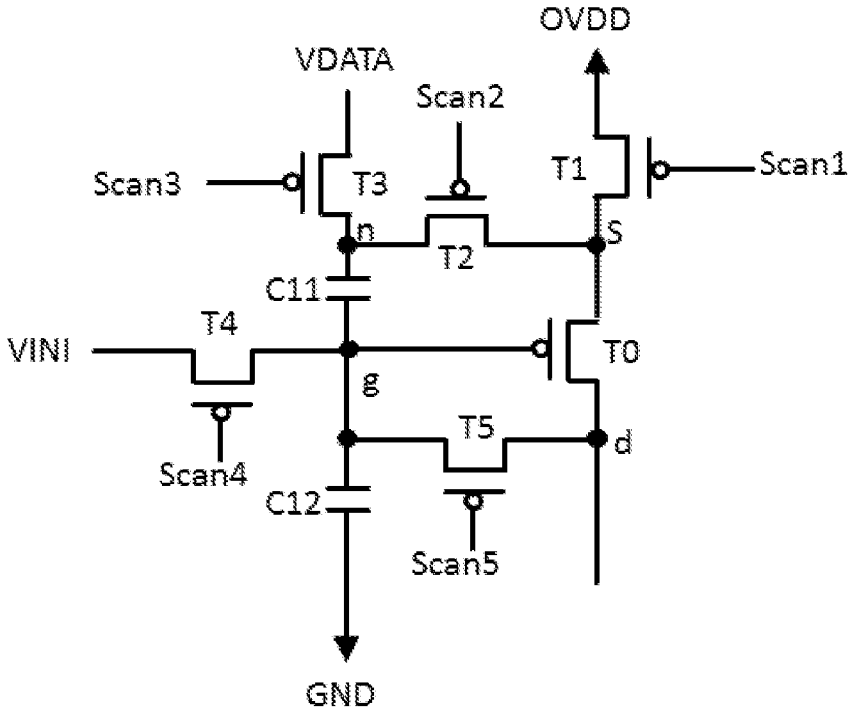
FIG. 1 is a structural illustrative diagram of a pixel driving circuit of a first embodiment according to the present application.

Please refer to FIG. 1, which a pixel driving circuit is provided in the first embodiment of the present application. the pixel driving circuit comprises A driving transistor T0, a first switch T1, a second switch T2, a third switch T3, a fourth switch T4, a fifth switch T5, a first capacitor C11, a second capacitor C12, a charge-voltage terminal n, an initial-voltage-signal terminal VINI, a data-voltage-signal terminal VDATA and a driving-voltage-signal terminal OVDD. The driving transistor T0 comprises a gate terminal g, a source terminal s and a drain terminal d.

The source terminal s is respectively connected with the driving-voltage-signal terminal OVDD and the charge-voltage terminal n via the first switch T1 and the second switch T2. The charge-voltage terminal n is connected with the driving-voltage-signal terminal OVDD via the third switch T3, for loading a driving voltage Vdd or a data voltage Vdata at the source terminal s. The gate terminal g is connected with the initial-voltage-signal terminal VINI via the fourth switch T4, for loading an initial voltage Vini at the gate terminal g. The gate terminal g and the drain terminal d are connected with the fifth switch T5. The first capacitor C11 is connected with the gate terminal g and the charge-voltage terminal n, for storing a potential difference between the gate terminal g and the charge-voltage terminal n. The second capacitor C12 is connected with the gate terminal g and a ground terminal GND, for storing a potential of the gate terminal g. The switch described in this embodiment includes but is not limited to a module having a control circuit with on/off function such as a switch circuit, a thin film transistor and the like.

With a driving method, the pixel driving circuit provided in this embodiment controls the third switch T3 and the fourth switch T4 to be turned on, and the first switch T1, the second switch T2, the fifth switch T5, and the sixth switch T6 are turned off, the charge-voltage terminal n is loaded with the data voltage Vdata, and the gate terminal g is loaded with the initial voltage Vini, during a reset phase; during the storage phase, the second switch T2, the third switch T3 and the fifth switch T5 are turned on, and the first switch T1, the fourth switch T4 and the sixth switch T6 are turned off, the source terminal s is loaded with the data voltage Vdata. The data voltage Vdata charges the gate terminal g; during the lighting phase, the third switch T3, the first switch T1, and the sixth switch T6 are turned on, and the second switch T2, the fifth switch T5, and the fourth switch T4 are turned off, so that the driving current I generated by the driving transistor T0 is independent of the threshold voltage Vth, so that the driving current I generated by the driving transistor T0 is stable.

In one embodiment, the pixel driving circuit further comprises a first control-signal terminal Scan1 and a second control-signal terminal Scan2. The first control-signal terminal Scan1 and the second control-signal terminal Scan2 are respectively connected with a control terminal of the first switch T1 and a control terminal of the second switch T2, so as to control on/off of the first switch T1 and the second switch T2.

In one embodiment, the pixel driving circuit further comprises a third control-signal terminal Scan3 and a fourth control-signal terminal Scan4. The third control-signal terminal Scan3 and the fourth control-signal terminal Scan4 are respectively connected with a control terminal of the third switch T3 and a control terminal of the fourth switch T4, so as to control on/off of the third switch T3 and the fourth switch T4.

In one embodiment, the pixel driving circuit further comprises a fifth control-signal terminal Scan5. The fifth control-signal terminal Scan5 is connected with a control terminal of the fifth switch T5, so as to control on/off of the fifth switch T5.

Figure 2:
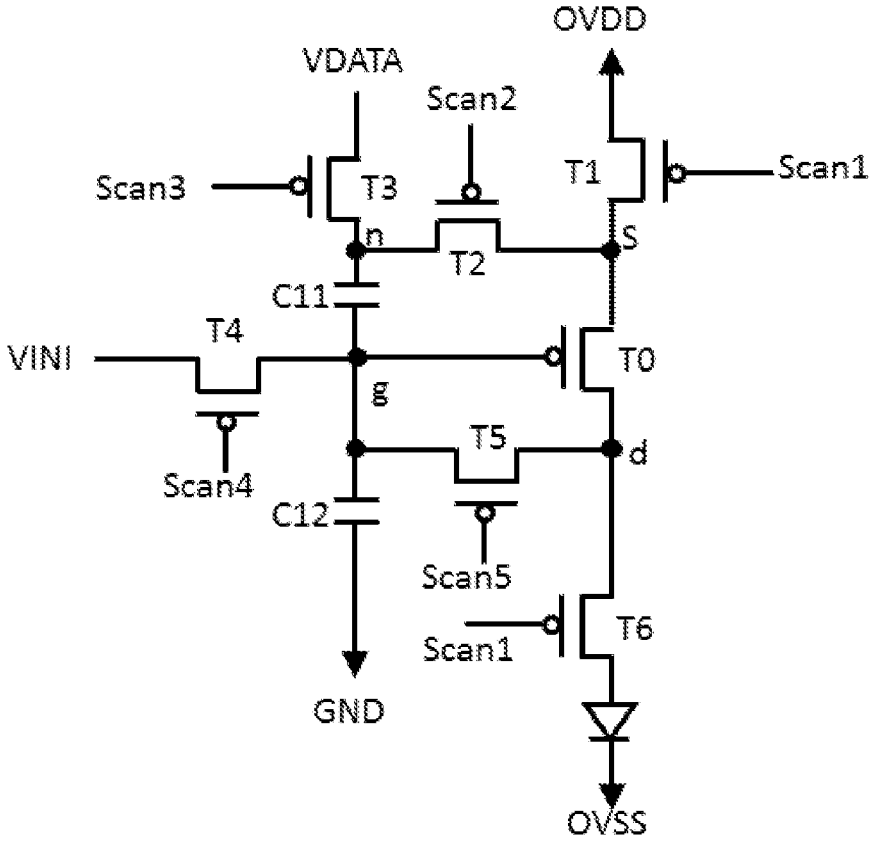
FIG. 2 is a structural illustrative diagram of a pixel driving circuit of a second embodiment according to the present application.

Please refer to FIG. 2, which is a pixel driving circuit of a second embodiment according to the present application, which comprises the pixel driving circuit provided by the first embodiment, making the driving current I generated by the driving transistor T0 stable. The present embodiment further comprises a sixth switch T6, a light-emitting diode L, and a negative voltage-signal terminal OVSS. The first control-signal terminal Scan1 is connected with a control terminal of the sixth switch T6, so as to control on/off of the sixth switch T6. The light-emitting diode L has a positive terminal and a negative terminal. The sixth switch T6 is connected between the drain terminal d and the positive terminal, so as to control on/off of the driving transistor T0 and the light emitting diode L. The negative terminal is connected with the negative voltage-signal terminal OVSS. When the first switch T1, the driving transistor T0, and the sixth switch T6 are turned on, the driving-voltage-signal terminal OVDD and the negative voltage-signal terminal OVSS are conducted, and the driving current I generated by the driving transistor T0 drives the light-emitting diode L to light. In this embodiment, the driving current I is independent of the threshold voltage Vth of the driving transistor T0, which eliminates the problem of threshold voltage Vth shift caused by the aging of the driving transistor T0 or the manufacturing process of the pixel unit, so that the current flowing through the light-emitting diode L, the luminance of the light-emitting diode L is ensured to be uniform, and the display effect of the picture is improved.

In one embodiment, the first switch T1, the driving transistor T0, the second switch T2, the fourth switch T4, the fifth switch T5, and the sixth switch T6 are all P-type thin film transistors. When the control terminal of the switch is applied with a low-level voltage, the switch is in the on state, and the switch is in the off state when a high-level voltage is applied to the control terminal of the switch. In other embodiments, the first switch T1, the driving transistor T0, the second switch T2, the third switch T3, the fourth switch T4, and the fifth switch T5 may be other combination of P-type or/and N-type thin film transistor, the present application do not limit this.

In the embodiment of the present application, when the pixel driving circuit is applied to a display panel or a display device, the control-signal terminal may be connected with the scanning signal line in the display panel or the display device.

Figure 3:
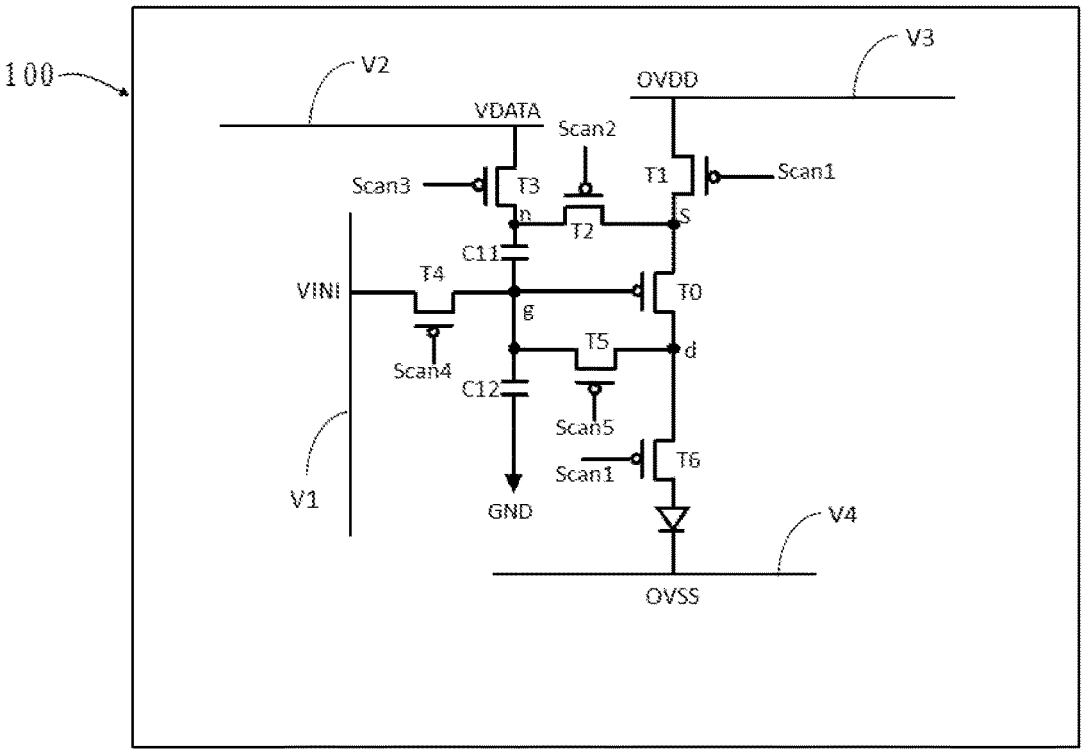
FIG. 3 is a structural illustrative diagram of a display panel of an embodiment according to the present application.

Please refer to FIG. 3, the embodiment of the present application further provides a display panel 100 comprising the pixel driving circuit provided in any one of the above embodiments and further comprises an initial-voltage-signal line V1, a data-voltage-signal line V2, a driving-voltage-signal line V3, and a negative voltage-signal line V4. The initial-voltage-signal terminal VINI is connected with the initial-voltage-signal line V1 to load the initial voltage Vini. The data-voltage-signal terminal VDATA is connected with the data-voltage-signal line V2 to load the data voltage Vdata. The driving-voltage-signal terminal OVDD is connected with the driving-voltage-signal line V3 for loading the driving voltage Vdd. The negative voltage-signal terminal OVSS is connected with the negative voltage-signal line V4 to load the negative voltage Vss. Specifically, the display panel may comprise a plurality of pixel arrays, and each pixel corresponds to any one of the pixel driving circuits in the above example embodiment. Since the pixel driving circuit eliminates the influence of the threshold voltage on the driving current I, the display of the light-emitting diode L is stable and the display brightness uniformity of the display panel is improved. Therefore, the display quality can be greatly improved.

Figure 4:
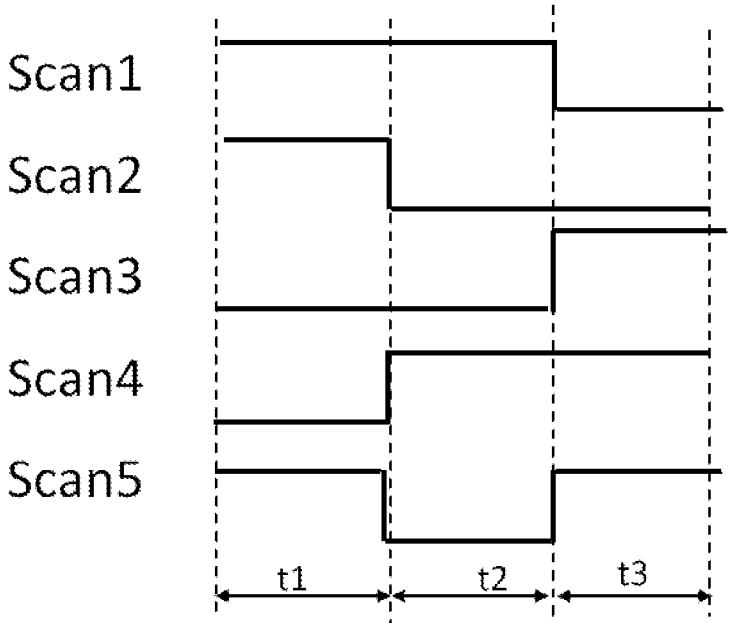
FIG. 4 is a time-domain diagram of a pixel driving circuit of an embodiment according to the present application.
Figure 5:
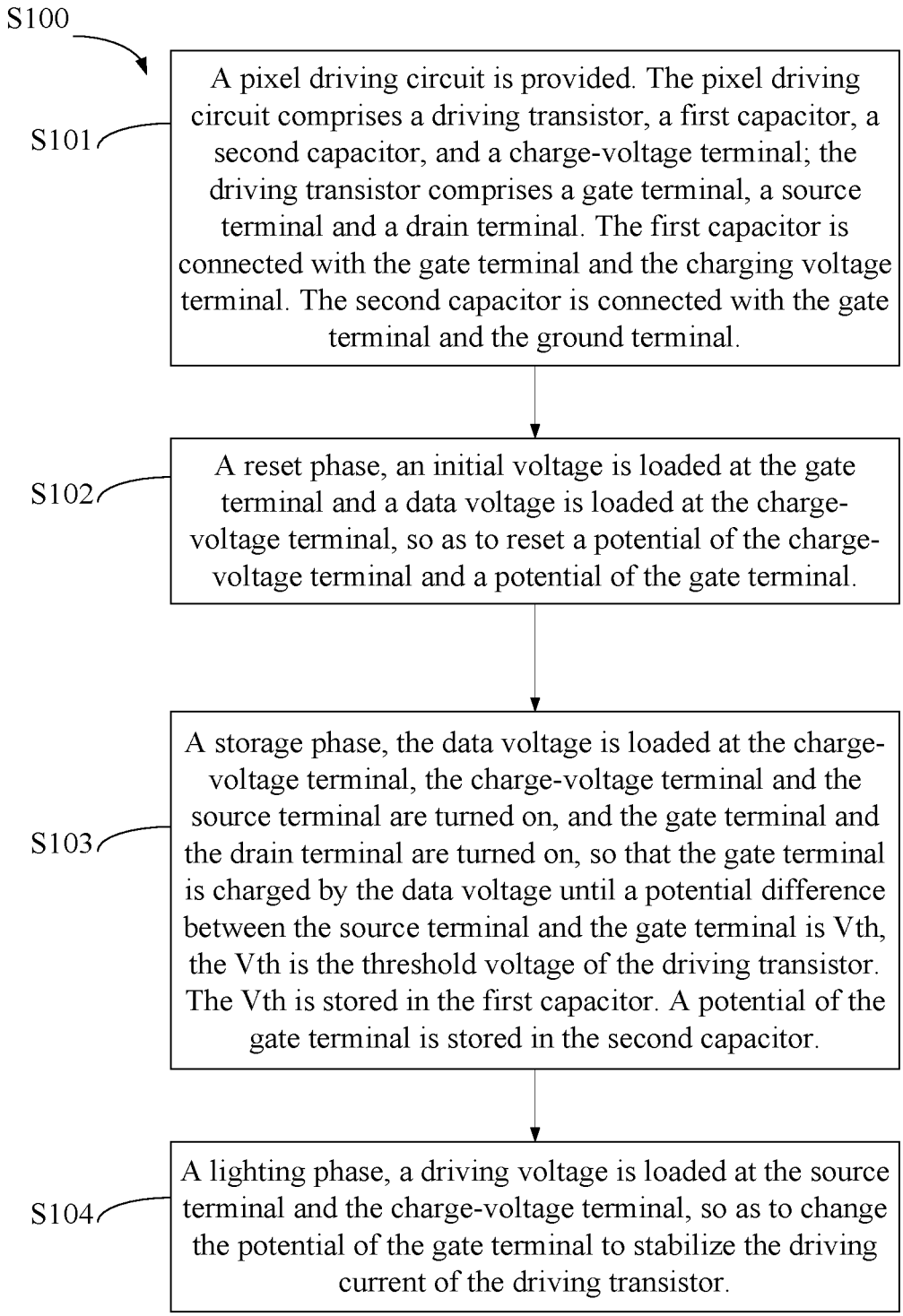
FIG. 5 is a flow diagram of a pixel driving method of one embodiment according to the present application.

Please further refer to FIGS. 4-8; FIG. 4 is a time-domain diagram of a pixel driving circuit of an embodiment according to the present application. FIG. 5 is a flow diagram of a pixel driving method S100 of one embodiment according to the present application, which is used for driving the pixel driving circuit of the above embodiment. The driving method comprises:

S101, refer to FIGS. 2-3, a pixel driving circuit is provided, which comprises a driving transistor T0, a first capacitor C11, a second capacitor C12, and a charge-voltage terminal n. The driving transistor T0 comprises a gate terminal g, a source terminal s, and a drain terminal d. The first capacitor C11 is connected between the gate terminal g and the charge-voltage terminal. The second capacitor C12 is connected between the gate terminal g and a ground terminal.

Further, the pixel driving circuit further comprises an initial-voltage-signal terminal VINI, a data-voltage-signal terminal VDATA, and a driving-voltage-signal terminal OVDD. The initial-voltage-signal terminal VINI is connected with the initial-voltage-signal line V1 for loading the initial voltage Vini. The data-voltage-signal terminal VDATA is connected with the data-voltage-signal line V2 for loading the data voltage Vdata. The driving-voltage-signal terminal OVDD is connected with the driving-voltage-signal line V3 for loading the driving voltage Vdd.

Further, the pixel driving circuit provided further comprises a first switch T1, a second switch T2, a third switch T3, a fourth switch T4, a fifth switch T5, a sixth switch T6, a light-emitting diode L, a first control-signal terminal Scan1, a second control-signal terminal Scan2, a third control signal terminal Scan3, a fourth control-signal terminal Scan4, a fifth control-signal terminal Scan5, an initial-voltage-signal terminal VINI, a data-voltage-signal terminal VDATA, and a driving-voltage-signal terminal OVDD. The source terminal s is respectively connected with the driving-voltage-signal terminal OVDD and the charge-voltage terminal n via the first switch T1 and the second switch T2. The charge-voltage terminal n is connected with the data-voltage-signal terminal VDATA via the third switch T3. The gate terminal g is connected to the initial-voltage-signal terminal VINI via the fourth switch T4, and the gate terminal g and the drain terminal d are connected via the fifth switch T5. The sixth switch T6 is connected with the drain terminal d and the light-emitting diode L. The first control-signal terminal Scan1 is connected with the control terminal of the first switch T1 and the control terminal of the sixth switch T6. The second control-signal terminal Scan2 is connected with the control terminal of the second switch T2. The third control-signal terminal Scan3 and the fourth control-signal terminal Scan4 are respectively connected with the control terminal of the third switch T3 and the control terminal of the fourth switch T4. The fifth control-signal terminal Scan5 is connected with the control terminal of the fifth switch T5.

Figure 6:
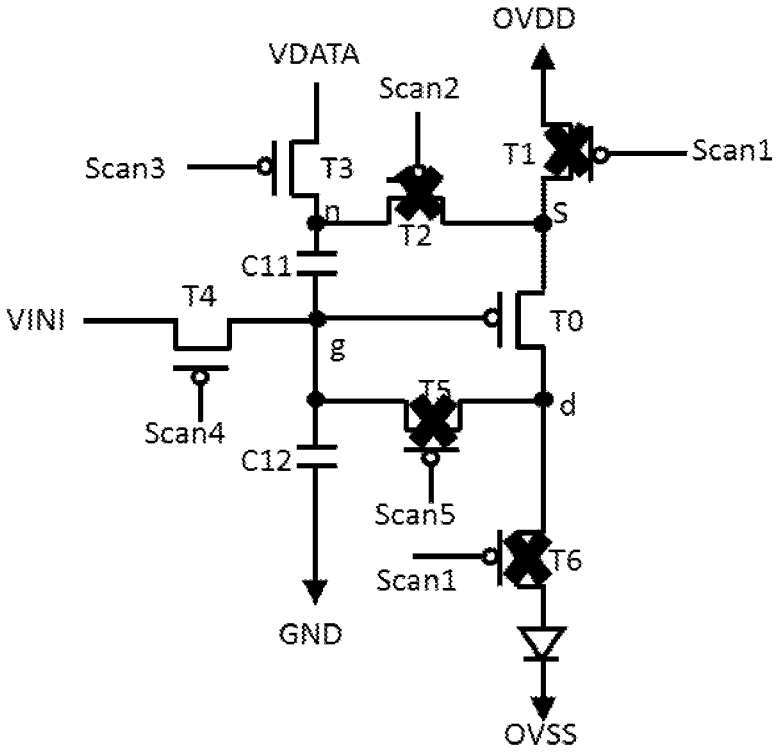
FIG. 6 is a state diagram of a reset phase of a pixel driving circuit according to an embodiment of the present application.

S102, referring to FIGS. 4-6, when entering the reset phase t1, an initial voltage Vini is applied to the gate terminal g and the data voltage Vdata is applied to the charge-voltage terminal n, such that the potential at the charge-voltage terminal n and the potential of the gate terminal g are reset.

In one embodiment, the third control-signal terminal Scan3 and the fourth control-signal terminal Scan4 are loaded with a low-level signal, and the first control-signal terminal Scan1, the second control-signal terminal Scan2, and the fifth control-signal terminal Scan5 are loaded with a high-level signal, so that the third switch T3 and the fourth switch T4 are turned on, the first switch T1, the second switch T2, the fifth switch T5, and the sixth switch T6 are turned off. The charge-voltage terminal n is loaded with the data voltage Vdata via the third switch T3. The gate terminal g is loaded with the initial voltage Vini via the third switch T3.

Figure 7:
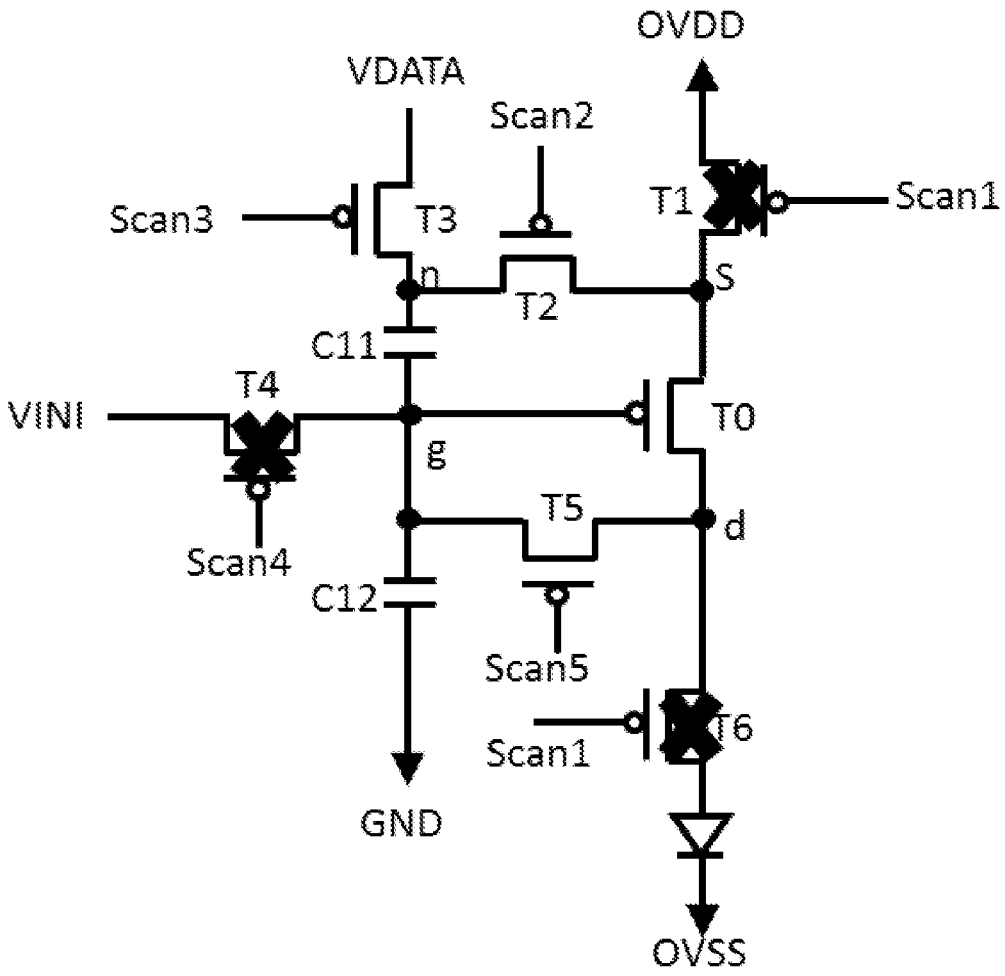
FIG. 7 is a state diagram of a storage phase of a pixel driving circuit according to an embodiment of the present application.

S103, refer to FIG. 4, FIG. 5 and FIG. 7, when entering the storage phase t2, the charge-voltage terminal is loaded with the data voltage Vdata, so that the charge-voltage terminal n and the source terminal s are conducted, the gate terminal g and the drain terminal d are conducted, so as to facilitate the data voltage Vdata charges the gate terminal g until the potential difference between the source terminal s and the gate terminal g is Vth, which is the threshold voltage of the driving transistor T0. Then the Vth is stored in the first capacitor C11, the potential of the gate terminal g is stored in the second capacitor C12.

In one embodiment, the second control-signal terminal Scan2, the third control-signal terminal Scan3, and the fifth control-signal terminal Scan5 are loaded with a low-level signal, and the fourth control-signal terminal Scan4 and the first control-signal terminal Scan1 are loaded with a high-level signal, so that the second switch T2, the third switch T3 and the fifth switch T5 are turned on, the first switch T1, the fourth switch T4, and the sixth switch T6 are turned off. The source terminal s is loaded with the data voltage Vdata via the second switch T2 and the third switch T3. The gate terminal g is charged by the data voltage Vdata via the third switch T3, the second switch T2, the driving transistor T0, and the fifth switch T5 until the potential of the gate terminal g is Vdata-Vth.

Figure 8:
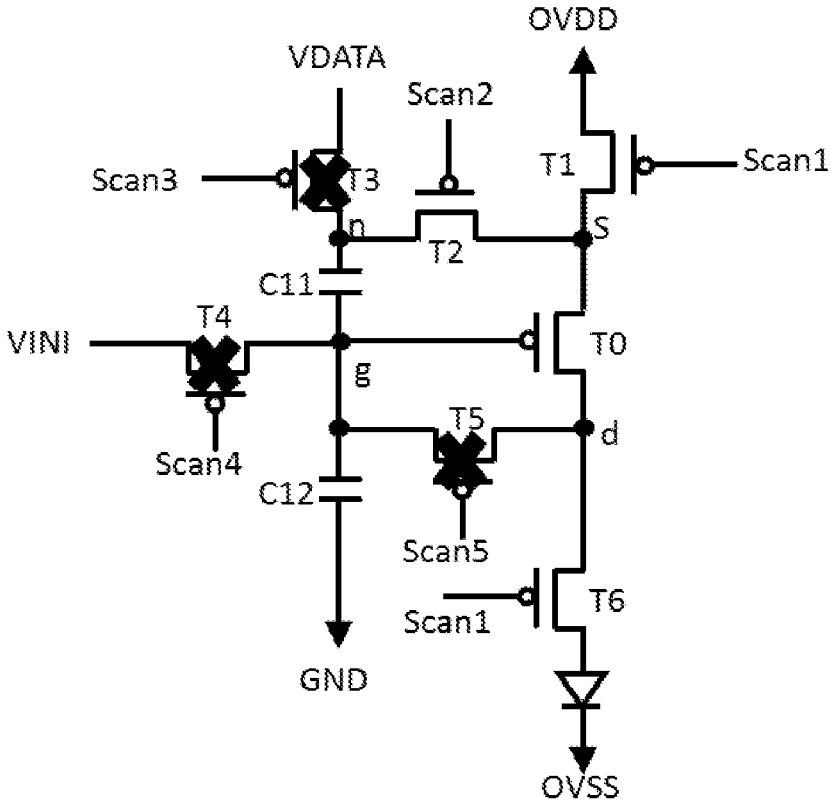
FIG. 8 is a state diagram of a lighting phase of a pixel driving circuit according to an embodiment of the present application.

S104, refer to FIG. 4, FIG. 5 and FIG. 8, when entering the lighting period t3, the charge-voltage terminal n is loaded with the driving voltage Vdd, so that the potential of the gate terminal g is changed, so that the driving current I of the driving transistor T0 is stable.

Further, the pixel driving circuit further comprises a negative voltage-signal terminal OVSS, and the light-emitting diode L comprises a positive terminal and a negative terminal. The sixth switch T6 is connected between the drain terminal d and the positive terminal. The negative terminal is connected with the negative voltage-signal terminal OVSS.

In one embodiment, the third control-signal terminal Scan3, the fifth control-signal terminal Scan5, and the fourth control-signal terminal Scan4 are loaded with a high-level signal, and the first control-signal terminal Scan1 and second control-signal terminal Scan2 are loaded with a low-level signal, so that the third switch T3, the first switch T1 and the sixth switch T6 are turned on, the second switch T2, the fifth switch T5, and the fourth switch T4 are turned off.

The first switch T1, the driving transistor T0, and the sixth switch T6 are turned on so that the driving-voltage-signal terminal OVDD and the negative voltage-signal terminal OVSS are conducted, so that the driving current I drives the light-emitting diode L for lighting. The source terminal s is loaded with the driving voltage Vdd via the first switch T1. The charge-voltage terminal n is charged by the driving voltage Vdd via the first switch T1 and the third switch T3, and the potential of the gate terminal g is changed. According to the charge sharing principle, the potential at the gate terminal g is Vdata−Vth+δV, the potential difference between the potential at the source terminal s and the potential at the gate terminal g is Vdd−Vdata+Vth−δV, and δV=(Vdd−Vdata)*C2/(C1+C2), C1 is a capacitance of the first capacitor C11, and C2 is a capacitance of the second capacitor C12. According to a transistor I-V curve equation $I=k(Vsg-Vth)^2$, where Vsg is a potential difference between a potential of the source terminal s and a potential of the gate terminal g, $I=k[Vdd-Vdata)*C1/(C1+C2)]^2$, k is the intrinsic conduction factor of the driving transistor T0, which is determined by the characteristics of the driving transistor T0 itself. It can be seen that the driving current I is independent of the threshold voltage Vth of the driving transistor T0, and the driving current I is the current flowing through the light-emitting diode L. Therefore, the pixel driving circuit driven by the pixel driving method provided in this embodiment of the present application eliminates the influence of the threshold voltage Vth on the light-emitting diode L, improves the display uniformity of the panel, and improves the luminous efficiency.

The foregoing disclosure is merely one preferred embodiment of the present application, and certainly cannot be used to limit the scope of the present application. A person having ordinary skill in the art may understand that all or part of the processes in the foregoing embodiments may be implemented, and the present application may be implemented according to the present application, equivalent changes in the requirements are still covered by the application.

What is claimed is:

1. A pixel driving circuit, comprising a driving transistor, a first switch, a second switch, a third switch, a fourth switch, a fifth switch, a first capacitor, a second capacitor, a charge-voltage terminal, an initial-voltage-signal terminal, a data-voltage-signal terminal, and a driving-voltage-signal terminal; wherein the driving transistor comprises a gate terminal, a source terminal, and a drain terminal;

the source terminal is respectively connected with the driving-voltage-signal terminal and the charge-voltage terminal via the first switch and the second switch, the charge-voltage terminal is connected with the data-voltage-signal terminal via the third switch; the gate terminal is connected with the initial-voltage-signal terminal via the fourth switch, and the gate terminal is connected with the drain terminal via the fifth switch;

the first capacitor is connected with the gate terminal and the charge-voltage terminal, the second capacitor is connected with the gate terminal and a ground terminal.

2. The pixel driving circuit according to claim 1, further comprising a first control-signal terminal and a second control-signal terminal, wherein the first control-signal terminal and second control-signal terminal are respectively connected with a control terminal of the first switch and a control terminal of the second switch, so as to control on/off of the first switch and the second switch.

3. The pixel driving circuit according to claim 2, further comprising a third control-signal terminal and a fourth control-signal terminal, wherein the third control-signal terminal and the fourth control-signal terminal are respectively connected with a control terminal of the third switch and a control terminal of the fourth switch, so as to control on/off of the third switch and the fourth switch.

4. The pixel driving circuit according to claim 3, further comprising a fifth control-signal terminal, wherein the fifth control-signal terminal is connected with a control terminal of the fifth switch, so as to control on/off of the fifth switch.

5. The pixel driving circuit according to claim 4, further comprising a sixth switch, a light-emitting diode and a negative voltage-signal terminal; wherein the first control-signal terminal is connected with a control terminal of the sixth switch to control on/off of the sixth switch; the light-emitting diode comprises a positive terminal and a negative terminal, the sixth switch is connected between the drain terminal and the positive terminal to control on/off of the driving transistor and the light-emitting diode, the negative terminal is connected with the negative voltage-signal terminal.

6. A display panel, comprising a pixel driving circuit, wherein the pixel driving circuit comprises a driving transistor, a first switch, a second switch, a third switch, a fourth switch, a fifth switch, a first capacitor, a second capacitor, a charge-voltage terminal, an initial-voltage-signal terminal, a data-voltage-signal terminal, and a driving-voltage-signal terminal; wherein the driving transistor comprises a gate terminal, a source terminal, and a drain terminal;

the source terminal is respectively connected with the driving-voltage-signal terminal and the charge-voltage terminal via the first switch and the second switch, the charge-voltage terminal is connected with the data-voltage-signal terminal via the third switch; the gate terminal is connected with the initial-voltage-signal terminal via the fourth switch, and the gate terminal is connected with the drain terminal via the fifth switch;

the first capacitor is connected with the gate terminal and the charge-voltage terminal, the second capacitor is connected with the gate terminal and a ground terminal.

7. The display panel according to claim 6, further comprising a first control-signal terminal and a second control-signal terminal, wherein the first control-signal terminal and second control-signal terminal are respectively connected with a control terminal of the first switch and a control terminal of the second switch, so as to control on/off of the first switch and the second switch.

8. The display panel according to claim 7, further comprising a third control-signal terminal and a fourth control-signal terminal, wherein the third control-signal terminal and the fourth control-signal terminal are respectively connected with a control terminal of the third switch and a control terminal of the fourth switch, so as to control on/off of the third switch and the fourth switch.

9. The display panel according to claim 8, further comprising a fifth control-signal terminal, wherein the fifth control-signal terminal is connected with a control terminal of the fifth switch, so as to control on/off of the fifth switch.

10. The display panel according to claim 9, further comprising a sixth switch, a light-emitting diode and a negative voltage-signal terminal; wherein the first control-signal terminal is connected with a control terminal of the sixth switch to control on/off of the sixth switch; the light-emitting diode comprises a positive terminal and a negative terminal, the sixth switch is connected between the drain terminal and the positive terminal to control on/off of the driving transistor and the light-emitting diode, the negative terminal is connected with the negative voltage-signal terminal.

11. A pixel driving method, comprising:

providing a pixel driving circuit, which comprises a driving transistor, a first capacitor, a second capacitor, and a charge-voltage terminal; the driving transistor comprises a gate terminal, a source terminal and a drain terminal; the first capacitor is connected with the gate terminal and the charging voltage terminal; the second capacitor is connected with the gate terminal and the ground terminal;

a reset phase, loading an initial voltage at the gate terminal and loading a data voltage at the charge-voltage terminal, so as to reset a potential of the charge-voltage terminal and a potential of the gate terminal;

a storage phase, loading the data voltage at the charge-voltage terminal, turning on the charge-voltage terminal and the source terminal, and turning on the gate terminal and the drain terminal, so that the gate terminal is charged by the data voltage until a potential difference between the source terminal and the gate terminal is Vth, the Vth is the threshold voltage of the driving transistor, and the Vth is stored in the first capacitor, and a potential of the gate terminal is stored in the second capacitor;

a lighting phase, loading a driving voltage at the source terminal and the charge-voltage terminal, so as to change the potential of the gate terminal to stabilize the driving current of the driving transistor.

12. The pixel driving method according to claim 11, wherein the pixel driving circuit further comprises a first switch, a second switch, a third switch, a fourth switch, a fifth switch, a sixth switch, a light-emitting diode, a first control-signal terminal, a second control-signal terminal, a third control-signal terminal, a fourth control-signal terminal, a fifth control-signal terminal, an initial-voltage-signal terminal, a data-voltage-signal terminal, and a driving-voltage-signal terminal; the source terminal is respectively connected with the driving-voltage-signal terminal and the charge-voltage terminal via the first switch and the second switch, the charge-voltage terminal is connected with the data-voltage-signal terminal via the third switch; the gate terminal is connected with the initial-voltage-signal terminal via the fourth switch, the gate terminal is connected with the drain terminal via the fifth switch; the sixth switch is connected between the drain terminal and the light-emitting diode; the first control-signal terminal is connected with a control terminal of the first switch and a control terminal of the sixth switch, the second control-signal terminal is connected with a control terminal of the second switch; the third control-signal terminal and the fourth control-signal terminal are respectively connected with a control terminal of the third switch and a control terminal of the fourth switch; the fifth control-signal terminal is connected with a control terminal of the fifth switch;

in the reset phase, loading the third control-signal terminal and the fourth control-signal terminal with a low-level signal, loading the first control-signal terminal, the second control-signal terminal, and the fifth control-signal terminal with a high-level signal, to turn on the third switch and the fourth switch, and turn off the first switch, the second switch, the fifth switch, and the sixth switch, loading the charge-voltage terminal with the data voltage via the third switch, the data voltage is Vdata, loading the gate terminal with the initial voltage via the fourth switch.

13. The pixel driving method according to claim 12, wherein in the storage phase, loading the second control-signal terminal, the third control-signal terminal and the fifth control-signal terminal with a low-level signal, loading the fourth control-signal terminal and the first control-signal terminal with a high-level signal, to turn on the second switch, the third switch, and the fifth switch, and turn off the first switch, the fourth switch, and the sixth switch turn off, loading the source terminal with the data voltage via the second switch and the third switch, and charging the gate terminal with the data voltage via data voltage the third switch, the second switch, the driving transistor, and the fifth switch, until a potential of the gate terminal is Vdata−Vth.

14. The pixel driving method according to claim 13, wherein the pixel driving circuit further comprises a negative voltage-signal terminal, the light-emitting diode comprises a positive terminal and a negative terminal, the sixth switch is connected between the drain terminal and the positive terminal, and the negative terminal is connected with the negative voltage-signal terminal;

in the lighting phase, loading the third control-signal terminal, the fifth control-signal terminal and the fourth control-signal terminal with a high-level signal, loading the first control-signal terminal and the second control-signal terminal with a low-level signal, so as to turn on the third switch, the first switch, and the sixth switch, and turn off the second switch, the fifth switch, and the fourth switch are turned off; loading the source terminal with the driving voltage via the first switch, the driving voltage is Vdd, charging the charge-voltage terminal with the driving voltage charges via the first switch and the third switch, the potential of the gate terminal is Vdata−Vth+δV, and the potential difference between the source terminal and the gate terminal is Vdd−Vdata+Vth−δV, and δV=Vdd−Vdata*C1/C1+C2), C1 is a capacitance value of the first capacitor, C2 is a capacitance value of the second capacitor, so that the driving current is independent of the threshold voltage; and the first switch, the driving transistor and the sixth switch are turned on, so that the driving-voltage-signal terminal and the negative voltage-signal terminal are turned on, for driving the light-emitting diode light by the driving current.

* * * * *